United States Patent [19]

Arabori et al.

[11] Patent Number: 4,501,945

[45] Date of Patent: Feb. 26, 1985

[54] MICROWAVE OVEN PROVIDED WITH TURNTABLE

[75] Inventors: Yoshinari Arabori; Hisao Sato, both of Nagoya, Japan

[73] Assignee: Tokyo Shibaura Denki Kabushiki Kaisha, Kawasaki, Japan

[21] Appl. No.: 502,336

[22] Filed: Jun. 8, 1983

[30] Foreign Application Priority Data

Jun. 9, 1982 [JP] Japan ..... 57-99010

[51] Int. Cl.[3] ..... H05B 6/78

[52] U.S. Cl. ..... 219/10.55 F; 219/10.55 E

[58] Field of Search ..... 219/10.55 F, 10.55 E, 219/10.55 R, 10.55 B

[56] References Cited

U.S. PATENT DOCUMENTS 4,326,113 4/1982 Toyoda et al. ..... 219/10.55 F X

FOREIGN PATENT DOCUMENTS 52-27388 6/1977 Japan .

54-91760 6/1979 Japan .

54-94938 7/1979 Japan .

*Primary Examiner*—Philip H. Leung

*Attorney, Agent, or Firm*—Schwartz, Jeffery, Schwaab, Mack, Blumenthal & Koch

[57] ABSTRACT

A microwave oven provided with a turntable device for generating microwave energy, a waveguide for coupling the microwave energy to a heating chamber defined by metal walls, a conical rotary support member disposed in the heating chamber for supporting the turntable on which a foodstuff to be cooked is mounted, and an electric motor for rotating the rotary support member. The conical rotary support member is provided with a plurality of arms and a peripheral edge to which the arms are connected and the arm and the peripheral edge define openings through which microwave energy reflected from the walls of the heating chamber passes. The conical rotary support member is further provided with a protruded member made of microwave reflecting material and arranged at the central portion of the rotary support member.

14 Claims, 8 Drawing Figures

MICROWAVE OVEN PROVIDED WITH TURNTABLE

BACKGROUND OF THE INVENTION

This invention relates to a high frequency electronic cooking device and more particularly to a microwave oven provided with an improved turntable support member.

Generally, in a high frequency electronic cooking device, a foodstuff to be cooked is heated by microwave energy generated from a magnetron and/or radiant heat from electric heaters.

The electronic cooking device of this type generally comprises a box-shaped cabinet, a control panel and an oven door which are arranged on the front side of the cabinet, a heating chamber located inside the oven door and defined by an oven frame, a waveguide provided at its one end with a port opened at the top wall of the heating chamber, a magnetron coupled to the other end of the waveguide, and a flat rotary disc on which a turntable is removably mounted. A pair of electric heaters are horizontally located in the heating chamber to heat the foodstuff mounted on the turntable from the upper and lower sides. An electric motor for driving the rotary disc is disposed below the bottom wall of the heating chamber through a drive shaft which extends into the oven through bearings provided at the central portion of the bottom wall.

In a typical known cooking device, the turntable is supported by the flat rotary disc in frictional engagement or in engagement with projections formed on the rotary disc and grooves formed on the rear surface of the turntable. In addition, in some cases a plurality of rollers are disposed on the bottom wall of the heating chamber so as to rotatably support the rotary disc and prevent undesired wobbling motion thereof. However, various problems have been encountered in these supporting structures when it is desired to exactly position the turntable on the rotary disc while rotating, firmly support same, and maintain the oven in a clean state after the heating operation, which disadvantages will be described in detail hereinafter with reference to accompanying drawings. Moreover, there is a problem that the foodstuff is not sufficiently and evenly heated for the reason that the electromagnetic waves concentrate at the edge portion of the flat rotary disc.

In order to obviate these disadvantages, there has been proposed an improved rotary support member in which the rotary disc is formed as a dish shaped member provided with through holes. However, this prior art design can also not positively support the turntable and uniformly heat the foodstuff on the turntable.

SUMMARY OF THE INVENTION

An object of this invention is to provide an improved microwave oven capable of positively supporting a turntable on which a foodstuff to be heated is mounted, and uniformly heating the foodstuff.

Another object of this invention is to provide a microwave oven having a dish-shaped rotary member provided with a protruded member at its central portion for supporting the turntable and uniformly heating the foodstuff mounted thereon.

According to this invention there is provided a microwave oven provided with a turntable comprising a device for generating microwave energy, a heating chamber defined by metal walls, an element for coupling the microwave energy to the heating chamber, a rotary support member provided in the heating chamber with a plurality of arms and a peripheral edge to which the arms are connected for supporting the turntable on which a foodstuff to be cooked is mounted, the arms and said peripheral edge defining openings in order for the microwave energy reflecting from the walls of the heating chamber to pass therethrough, a protruded member made of microwave reflecting material and arranged at the central portion of the rotary support member, and an electric motor for rotating the rotary support member.

DESCRIPTION OF THE PREFERRED EMBODIMENTS

Figure 1:
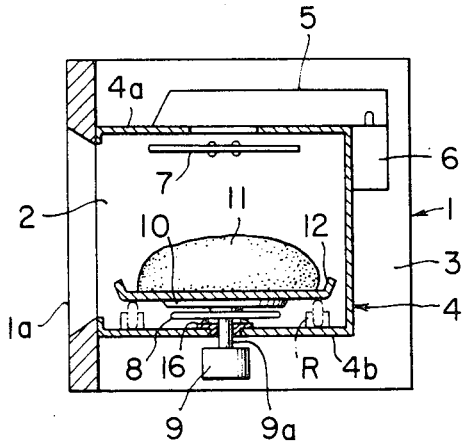
FIG. 1 PRIOR ART
FIG. 1 is a schematic elevational sectional view showing a conventional microwave oven with a turntable.
Figure 2:
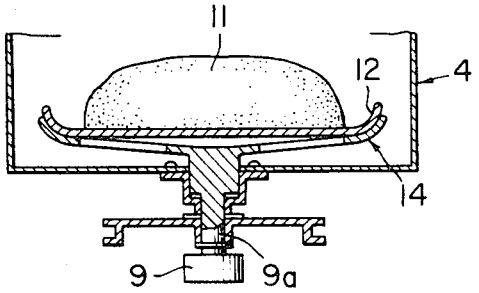
FIG. 2 PRIOR ART
FIG. 2 is a sectional view of one example of a conventional turntable supporting member disposed in a microwave oven.

To aid the full understanding of the present invention, general aspects of a high frequency electronic cooking device, particularly a microwave oven provided with heaters, and various problems encountered in known devices of this type will first be considered in conjunction with FIGS. 1 and 2.

Referring to FIG. 1, a microwave oven is provided with a housing 1 and a door 1*a* inside of which a heating chamber 2 and a machinery space 3 are defined by a metal wall 4 and along a top wall 4*a* is located a waveguide 5 having one end opened to the oven 2 and the other end operatively connected to a magnetron oscillator 6. An electric motor 9 is disposed below the bottom wall 4*b* and a drive shaft 9*a* of the motor 9 extends into the heating chamber 2 through bearings 16 provided at the central portion of the bottom wall 4*b*. The upper portion of the drive shaft 9*a* is connected to a flat rotary disc 10 and a turntable 12, made of glass, for instance, on which a foodstuff is rested, is frictionally mounted on the rotary disc 10 so that when the rotary disc 10 slowly rotates, the turntable 12 is also rotated. A pair of electric heaters 7 and 8 are located respectively at the upper and lower positions in the heating chamber 2 to heat the foodstuff from the upper and lower sides and the lower heater 8 is disposed between the bottom wall 4*b* and the rotary disc 10.

When the magnetron oscillator 6 is energized, microwave energy generated propagates through the waveguide 5 to heat the foodstuff 11 on the turntable 12 in the heating chamber 2, and at the same time, the drive motor 9 is driven to slowly rotate the rotary disc 10 and the turntable 12 so that the foodstuff is evenly heated.

However, since the turntable 12 is supported by the rotary disc 10 in only frictional engagement, it is relatively difficult to locate the turntable in a correct position on the rotary disc 10. Accordingly, the turntable 12 might slip or shift horizontally on the rotary disc 10 when it is rotated.

To obviate these defects, it has been proposed to form projections on the flat rotary disc 10 and grooves engaging with the projections on the rear surface of the turntable 12, but this construction is insufficient to prevent undesired wobbling motion of the turntable during rotation thereof.

A plurality of (at least three) rollers R, shown by dotted lines in FIG. 1, may be disposed on the bottom wall **4*b* to rotatably support the turntable 12 for preventing the undesired wobbling motion thereof. However, the location of rollers R on the bottom wall 4*b* makes it difficult to maintain the surface of the bottom wall 4*b* in a clean state after the heating operation of the microwave oven because the space between the bottom wall 4*b* and the rotary disc 10** is considerably narrow.

Figure 6:
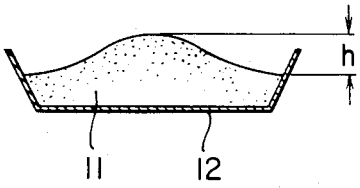
FIG. 6 is a diagrammatic sectional view showing a heated condition of a sponge cake having a central height h.

In order to obviate these disadvantages, there is disclosed in Japanese Utility Model Application (Application No. 56665/47) published June 22, 1977 (Publication No. 27388/52), a conical dish-shaped rotary support member for supporting the turntable 12 as shown in FIG. 2 by a reference letter 14. The dish-shaped support member 14 positively supports the turntable 12 at its peripheral edge portion. However, with the dish-shaped rotary member 14, the heating effect at the central portion is left out of consideration and the foodstuff 11 on the turntable is not evenly heated because the microwave energy generated from the magnetron oscillator generally concentrates at the peripheral edge of the rotary support member 14. Thus, the central portion of the foodstuff is not sufficiently heated and it remains with a certain height h uncooked as shown in FIG. 6 after a predetermined heating period of time.

Figure 3:
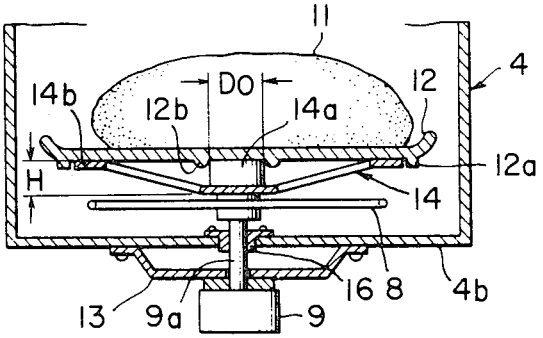
FIG. 3 is a sectional view of showing a turntable and a turntable support member according to this invention.

Referring to FIG. 3, in which like reference numerals are applied to elements corresponding to those shown in FIG. 1 or 2, an electric motor 9 is disposed below a metal bracket 13 attached to the bottom wall **4*b*. A drive shaft 9*a* coupled to the motor 9 extends into the heating chamber 2 through bearings 16 fixed to the bottom wall 4*b*. A box defined by the bottom wall 4*b* of the heating chamber 2 and the bracket 13 function as a ($\lambda/2$) electromagnetic choke which prevents the microwave energy from leaking outside of the heating chamber 2. The top portion of the drive shaft 9*a* is connected to a conical dish-shaped support member 14 on which a turntable 12 is supported and a lower heater 8 is horizontally disposed between the bottom wall 4*b* and the rotary support member 14. A protruded member 14*a* is formed at the central portion of the rotary support member 14. In shape the protruded member 14*a* is axially symmetrical with respect to the axis of the drive shaft 9*a* and, in height, is substantially equal to or slightly smaller than the height H of the rotary support member 14. A cylindrical member 14*a* is illustrated in FIG. 3 as one typical example. The protruded member 14*a* fixed to the support member 14 is made of microwave reflecting material such as metal. Therefore, the support member 14 and the protruded member 14*a*** may be integrally fabricated by treating a steel plate, for instance.

As shown in FIGS. **5*a* and 5*b*, the rotary support member 14 is provided with a peripheral edge 14*b* and a plurality of arms 14*c* which define openings 15 through which the microwave energy reflected from the walls 4, especially the bottom wall 4*b*, and radiant heat and hot air generated by the lower heater 8 (which is diagrammatically shown in FIG. 5*a* or 5*b*) passes when the food-stuff 11** is heated.

A plurality of projections **12*a* and 12*b* are formed on the rear surface of the turntable 12** to prevent it from accidentally shifting or slipping outwardly.

In our experimental evaluation for various types of rotary support members, a foodstuff on the turntable was heated under the same conditions of the microwave oven except for configuration of the rotary support members, and the results obtained are shown in the following Table 1.

The raw material was prepared to obtain a sponge cake by mixing a cake mix powder (375 g), water (200 cc), and one egg (50 g), and 300 g of the raw material thus prepared was heated by microwave output power 600 W frequency 2450 MHz) and electric heaters of resultant rated power consumptions 700 W (upper heater) and 500 W (lower heater) on a turntable having a diameter of 210 mm. After heating for a predetermined period of time the height h (FIG. 6) at the central portion of the material which is considered to be relatively insufficiently heated was measured to examine to what extent the material was evenly heated.

TABLE 1

| | Type A | Type B | Type C |
|---|---|---|---|
| heating time (seconds) | 330 | 330 | 330 |
| height h (mm) | 24 | 20 | 18 |

Type A: A flat rotary supporting disc 10 as shown in FIG. 1 was used.
Type B: A dish shaped supporting member 20 as shown in FIG. 2 was used.
Type C: A dish shaped supporting member 14 provided with a cylindrical protruded member 14a as shown in FIG. 3 was used and the protruded member 14a was about $\frac{1}{8}\lambda$ in diameter ($\lambda$ is the wavelength of microwave energy).

Type C was further experimented with changing diameter $D_0$ of the protruded cylindrical member **14*a*** and the result is shown in the following Table 2.

TABLE 2

| Diameter | $\frac{\lambda}{8}$ | $\frac{\lambda}{4}$ | $\frac{3}{8}\lambda$ | $\frac{\lambda}{2}$ | larger than $\frac{\lambda}{2}$ |
|---|---|---|---|---|---|
| heating time (seconds) | 330 | 300 | 270 | 300 | 330 |
| height h (mm) | 18 | 15 | 10 | 16 | 20–24 |

As can be understood from the Tables 1 and 2, a sponge cake heated effectively and uniformly is obtained in a shorter heating period of time when a dish shaped supporting member 14 is provided with a protruded cylindrical member **14*a*** ranging between about ($\lambda/2$) and ($\lambda/4$) in diameter.

Figure 4A:
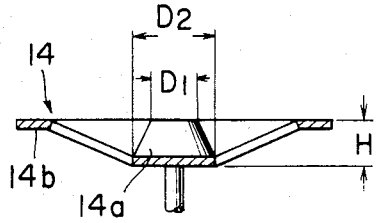
FIGS. 4*a* and 4*b* are sectional views showing other examples of a rotary support member according to this invention.
Figure 4B:
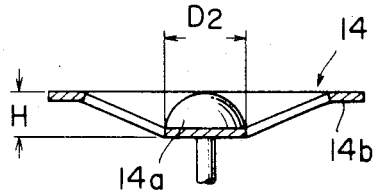

In our further experiment, a dish shaped supporting member 14 provided with a protruded member **14*a* having a frustoconical configuration as shown in FIG. 4*a*, was used to effectively utilize the microwave energy reflected by an inclined surface of the frustoconical member 14*a* and an obtained sponge cake showed that it was heated uniformly. In this case, the better result was obtained from constructing the frustoconical member 14*a* having a top diameter $D_1$ of about ($\lambda/4$) and a bottom diameter $D_2$ of about ($\lambda/2$) while slightly rounding the upper edge portion of the frustoconical member 14*a* so as to prevent excessive concentration of the electric field at the upper edge portion, thereby avoiding excessive heating of the edge portion of the sponge cake. As one of the various alternations, a roundly protruded member 14***a*, shown in FIG. 4*b*, having a diameter $D_2$ of about ($\lambda/2$) and a height H of about ($\lambda/8$) was formed on the rotary support member 14 and showed substantially the same result as in the case of the configuration illustrated in FIG. 4*a*. These experiments indicate that it is preferable to set the height H of the protruded member 14*a* to be about ($\lambda/8$).

Although in FIG. 3, the top surface of the cylindrical protruded member 14*a* shown in FIG. 3 is in direct contact with the lower surface of the turntable 12 to more firmly support the same, it should be better to slightly separate the top surface of the cylindrical member 14*a* from the turntable in case that heat is excessively transmitted to the member 14*a* from the turntable 12 due to the strong concentration of the electric field.

The protruded member may be constructed to be removable from the dish shaped support member.

Figure 5A:
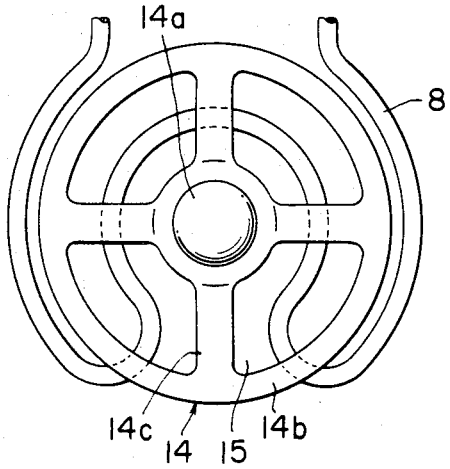
FIGS. 5*a* and 5*b* are plan views showing the rotary support members shown in FIGS. 4*a* and 4*b*, respectively, in which a lower heater is disposed.
Figure 5B:
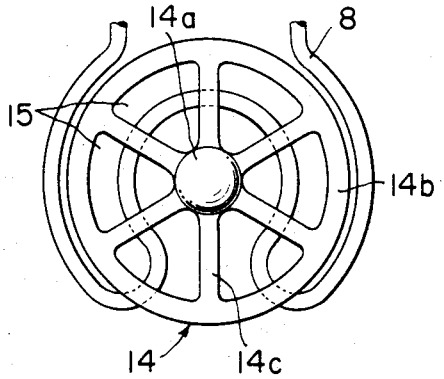

The number of arms of the support member 14 can be selected to a suitable number preferably 4 to 6 as shown in FIGS. 5*a* and 5*b* by taking into consideration the rigidity and the wavelength of the microwave.

What is claimed is:

1. A microwave oven comprising:

a heating chamber defined by microwave reflecting walls;

means for generating microwave energy;

means for coupling the microwave energy into said heating chamber;

a rotary support member within said heating chamber and adapted to support on its top surface a turntable, said rotary support including a central portion, a peripheral edge disposed substantially horizontally in said chamber, and arms interconnecting said central portion and peripheral edge and defining openings with said central portion and peripheral edge for permitting reflected microwave energy to pass through said support member, said central portion having a microwave reflecting member protruding centrally from said top surface, said microwave reflecting member being axially symmetric with respect to the axis of rotation of said support member and terminating before penetrating a plane defined by an upper surface of said peripheral edge; and means for rotating said rotary support member.

2. The microwave oven according to claim 1 wherein said microwave reflecting member and the turntable define a gap to avoid directly transferring heat from the turntable to said microwave reflecting member when the turntable is set on said rotary support member.

3. The microwave oven according to claim 2 wherein said microwave reflecting member comprises a single cylindrical member.

4. The microwave oven according to claim 3 wherein said cylindrical member has a diameter within a range between about ($\lambda/4$) and ($\lambda/2$), where $\lambda$ is a wavelength of the microwave energy.

5. The microwave oven according to claim 2 wherein said microwave reflecting member comprises a single frustoconical member.

6. The microwave oven according to claim 5 wherein said frustoconical member has an upper diameter of about ($\lambda/4$) and a lower diameter of about ($\lambda/2$), where $\lambda$ is a wavelength of the microwave energy.

7. The microwave oven according to claim 2 wherein said microwave reflecting member comprises a hemispherical member.

8. The microwave oven according to claim 7 wherein said hemispherical member has a bottom diameter of about $\lambda/2$, where $\lambda$ is a wavelength of the microwave energy.

9. The microwave oven according to claim 1 wherein said microwave reflecting member comprises a single cylindrical member.

10. The microwave oven according to claim 9 wherein said cylindrical member has a diameter within a range between about $\lambda/4$ and $\lambda/2$, where $\lambda$ is a wavelength of the microwave energy.

11. The microwave oven according to claim 1 wherein said microwave reflecting member comprises a single frustoconical member.

12. The microwave oven according to claim 11 wherein said frustoconical member has an upper diameter of about $\lambda/4$ and a lower diameter of about $\lambda/2$, where $\lambda$ is a wavelength of a microwave energy.

13. The microwave oven according to claim 1 wherein said microwave reflecting member comprises a single hemispherical member.

14. The microwave oven according to claim 13 wherein said hemispherical member has a bottom diameter of about $\lambda/2$, where $\lambda$ is a wavelength of the microwave energy.

* * * * *